US007519303B2

(12) United States Patent
Saeki

(10) Patent No.: US 7,519,303 B2
(45) Date of Patent: Apr. 14, 2009

(54) IMAGE FORMING APPARATUS WITH COLOR SHIFT CORRECTION

(75) Inventor: Kazuchika Saeki, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 327 days.

(21) Appl. No.: 11/279,193

(22) Filed: Apr. 10, 2006

(65) Prior Publication Data

US 2007/0014583 A1 Jan. 18, 2007

(30) Foreign Application Priority Data

Jul. 14, 2005 (JP) ..... 2005-205054

(51) Int. Cl.
*G03G 15/00* (2006.01)

(52) U.S. Cl. ..... 399/49; 399/302; 399/308; 399/313

(58) Field of Classification Search ..... 399/49, 399/72, 165, 302, 303, 308, 313
See application file for complete search history.

(56) References Cited

U.S. PATENT DOCUMENTS

| | | | | |
|---|---|---|---|---|
| 5,937,229 | A * | 8/1999 | Walgrove et al. | 399/49 |
| 6,160,978 | A * | 12/2000 | Tsuruoka et al. | 399/302 |
| 6,336,025 | B1 | 1/2002 | Saeki | |
| 6,701,100 | B2 * | 3/2004 | Tamiya et al. | 399/302 |
| 6,898,407 | B2 * | 5/2005 | Noguchi et al. | 399/302 |
| 6,904,245 | B2 * | 6/2005 | Mochizuki et al. | 399/49 |
| 7,149,444 | B2 * | 12/2006 | Tanaka et al. | 399/49 |
| 7,167,664 | B2 * | 1/2007 | Nomura et al. | 399/302 |
| 2002/0090225 | A1 * | 7/2002 | Takami et al. | |
| 2005/0047816 | A1 | 3/2005 | Uchida et al. | |

FOREIGN PATENT DOCUMENTS

| | | |
|---|---|---|
| JP | 1-167769 | 7/1989 |
| JP | 2573855 | 10/1996 |
| JP | 2609643 | 2/1997 |
| JP | 2659191 | 6/1997 |
| JP | 2000-214693 | 8/2000 |
| JP | 2002-229344 | 8/2002 |
| JP | 2005173114 A * | 6/2005 |

* cited by examiner

*Primary Examiner*—Susan S Lee
(74) *Attorney, Agent, or Firm*—Oblon, Spivak, McClelland, Maier & Neustadt, P.C.

(57) ABSTRACT

An image forming apparatus includes an intermediate transfer belt that moves while keeping contact with a photosensitive element at a transfer position, a control pattern forming unit that forms a control pattern on the intermediate transfer belt, a control pattern detecting unit that detects the control pattern; a deformation preventing unit arranged on a rear side of the moving member at a position facing the control pattern detecting unit; and tension applying members that applies tension to the intermediate transfer belt to tautly support the intermediate transfer belt. The deformation preventing unit and one of the tension applying members being a bias impressing unit that impresses a bias are arranged in close proximity to each other, and a surface of the deformation preventing unit is formed with an insulating material.

12 Claims, 3 Drawing Sheets

SF-1

IMAGE FORMING APPARATUS WITH COLOR SHIFT CORRECTION

CROSS-REFERENCE TO RELATED APPLICATIONS

The present document incorporates by reference the entire contents of Japanese priority document, 2005-205054 filed in Japan on Jul. 14, 2005.

BACKGROUND OF THE INVENTION

1. Field of the Invention

The present invention relates to a full color image forming apparatus that uses an electrophotographic method.

2. Description of the Related Art

In a conventional image forming apparatus, a toner image formed on an image carrier (hereinafter, "photosensitive member") is transferred onto a transfer sheet. The toner image is fixed on the transfer sheet by a fixing device by application of heat and pressure. In a full color image forming apparatus, the toner images of yellow, magenta, cyan, and black color formed on different photosensitive members are sequentially transferred on to the transfer sheet held by a transfer sheet carrier such as a transfer drum, after the toner images are developed. The transfer sheet is then removed from the transfer sheet carrier and the toner images thereon are fixed by the fixing device by application of heat and pressure.

In another full color image forming apparatus, instead of transferring the toner images onto the transfer sheet carried by the transfer sheet carrier, the four toner images superposed on an intermediate transfer member are batch-transferred on to the transfer sheet, and then fixed by the fixing device. The image forming apparatus that uses the intermediate transfer member is gaining ground due to increased printing speed enabled by transfer and superposition on the transfer sheet of all the toner images from a plurality of photosensitive members provided for each color and disposed in a row, by the time the intermediate transfer member has completed one rotation. The image forming apparatus using the intermediate transfer member does not require a transfer sheet carrier, and thus can support a wide range of transfer sheets from a thin paper (40 g/m2), a thick paper (200 g/m2), a post card, an envelope, etc. The intermediate transfer member is generally formed in a form of a drum or a belt. The disadvantage of the image forming apparatus using the intermediate transfer member is that if the image position of each color shifts, the reproduced color image also manifests a color shift, resulting in improper image reproduction.

As a measure against such color shift, a color shift detection pattern for each color is formed on the photosensitive member of an image forming unit of the respective color. These patterns are then transferred onto the intermediate transfer belt and are read by pattern detector. The color shift in a main scanning direction and a sub-scanning direction are detected based on output signals of the pattern detector and a feedback is given to a mechanical optical system including a mirror. Thus, the image writing position and the color shift due to a skew in the image position in the main scanning direction can be corrected for each image forming unit. Thus, it is possible to accurately position the image of each color. The pattern detector includes a light emitter and a light receiver. When the light from the light emitter is reflected off the intermediate transfer belt and enters the light receiver, the light is not reflected by the pattern transferred from the image carrier of the respective image forming unit. Therefore, a shift in the pattern position is detected by measuring the timing of the output signal from the light receiver.

For example, Japanese Patent No. 2609643 discloses a technology in which a memory unit that sequentially stores a registration mark image read by the pattern detector.

Japanese Patent No. 2659191 discloses a technology in which the registration marks formed on the belt and a mark calibrated on the belt are detected, and image shift correction is based on the magnitude of shift between the two marks.

Japanese Patent Laid-Open Publication No. H01-167769 discloses a printer in which space is efficiently used. In this printer, a density pattern image is transferred onto the transfer belt so that a stable color reproduction is obtained, and a process condition of each image forming station is controlled by optically measuring the density of the density pattern image. A detector to detect density of the density pattern image is configured to also function as a detection system to optically detect positioning patterns required for correcting color shifts.

However, none of the above disclosures provide satisfactory measures to ensure a stable distance between the belt and the detector or prevention of deformation of the belt during rotation, which are essential for a high degree of precision in pattern detection.

Japanese Patent Laid-Open Publication No. 2000-214693 discloses a technology in which a belt regulating member is provided near the detector.

While color shift correction or image density adjustment control, which takes a specific amount of time, the image forming apparatus cannot output images, cutting into productive time. Therefore, full color image forming apparatus that takes the shortest possible time for shift correction and adjustment is demanded.

Therefore, it is preferable that the pattern detector is located as close to the photosensitive member as possible. The pattern transferred onto the belt from the photosensitive member thus reaches the pattern detector and the pattern reading can be completed in a short time.

However, since a regulating member that prevents deformation of the belt is also close to the photosensitive member, the pattern detector becomes closed to bias rollers, over which the belt is tautly wound. If the pattern detector is closed to the regulating member to the bias rollers, the bias applied by the bias rollers during transfer of toner image or transfer sheet separation, leak occurs with respect to the regulating member. As a result, a noise that causes malfunction of the image forming apparatus itself, void, poor transfer sheet separation, and poor discharge due to temporary weakening of the electric field caused by the leak can occur.

SUMMARY OF THE INVENTION

It is an object of the present invention to at least solve the problems in the conventional technology.

An image forming apparatus according to one aspect of the present invention includes an image carrier; a latent image forming unit configured to form a latent image on the image carrier; a developing unit configured to form a plurality of toner images of the latent image, the toner images formed in different colors; a moving member configured to move in contact with the latent image bearing unit at a transfer position; a control pattern forming unit configured to form a control pattern on the moving member; a control pattern detecting unit configured to detect the control pattern; a deformation preventing unit arranged on a rear side of the moving member at a position facing the control pattern detecting unit; and a plurality of tension applying members configured to apply tension to the moving member from inside a structure of the moving member to tautly support the moving member. The deformation preventing unit and one of the tension applying members being a bias impressing unit that impresses a bias are arranged in close proximity to each other, and a surface of the deformation preventing unit is formed with an insulating material.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Exemplary embodiments of the present invention are explained in detail below with reference to the accompanying drawings. Although the invention has been described with respect to a specific embodiment for a complete and clear disclosure, the appended claims are not to be thus limited but are to be construed as embodying all modifications and alternative constructions that may occur to one skilled in the art which fairly fall within the basic teaching herein set forth.

Figure 1:
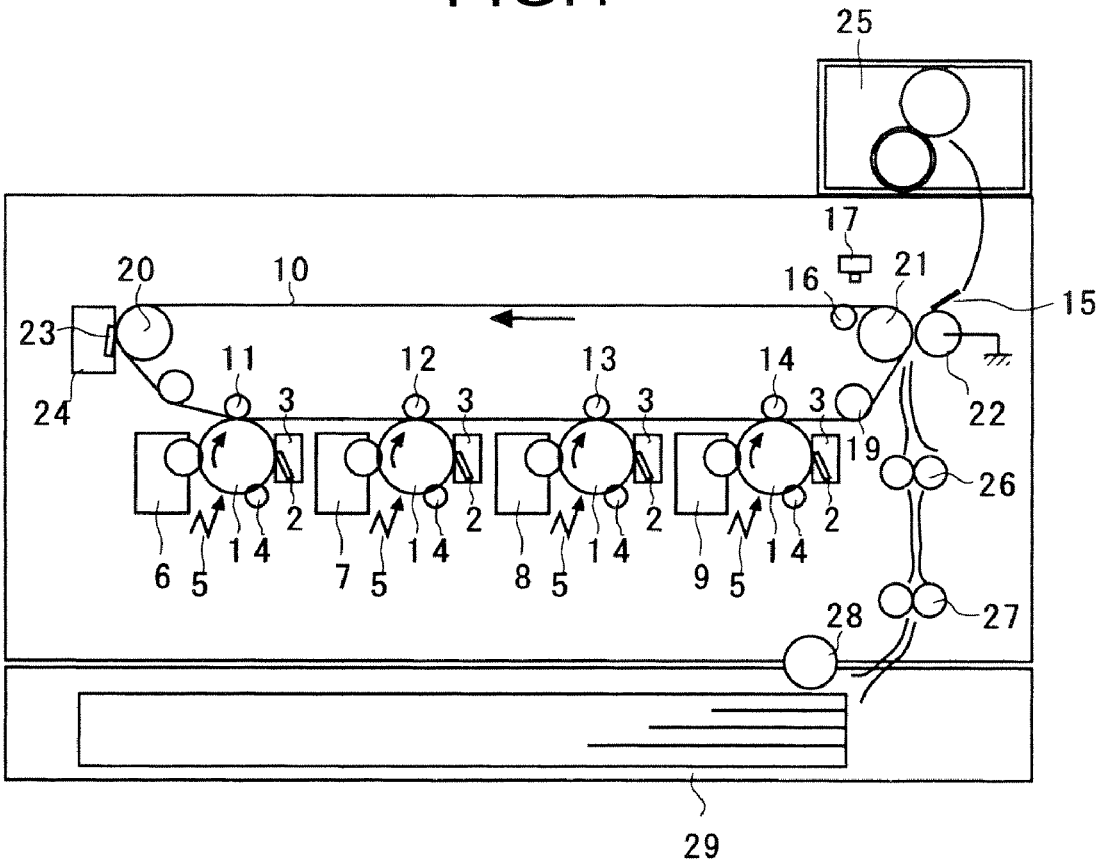
FIG. 1 is a schematic of a color image forming apparatus according to embodiments of the present invention that uses an intermediate transfer belt as an intermediate transfer member.

FIG. 1 is a schematic of a color image forming apparatus according to the embodiments of the present invention. The color image forming apparatus uses an intermediate transfer belt as an intermediate transfer member. A cylindrical photosensitive drum 1 rotates in the direction of the arrow and has a rotation speed of 150 mm/sec. A roller-shaped charging unit in the form of a charging device 4 is pressed against the surface of the photosensitive drum 1 and is induced to rotate by the turning photosensitive drum 1. A not shown high voltage power source impresses an AC and DC bias on the surface of photosensitive drum 1, which is charged to −500 volts (V).

An electrostatic image forming unit in the form of an exposing unit 5 exposes image data on the photosensitive drum 1 to form an electrostatic latent image. The exposure is performed by a laser beam scanner or a light-emitting diode (LED) that employs a laser diode.

A photosensitive drum cleaning unit 3 cleans the residual toner left on a surface of the photosensitive drum 1 after the transfer of the toner image has taken place. The reference numeral 2 in FIG. 1 represents a blade of the photosensitive drum cleaning unit 3. A developing unit in the present embodiment is a two-component non-magnetic contact developer and includes four developers, namely, a yellow developer 6, a cyan developer 7, a magenta developer 8, and a black developer 9. Each of the developers receives a predetermined developing bias from a high-voltage power source and converts the electrostatic latent image on the photosensitive drum 1 to a visible toner image. The toner used in the present embodiment is a polymer toner produced by a polymerization method. The shape of the toner particle will be described later.

Four photosensitive drums 1 are arranged in a row, each bearing thereon a visible toner image of one of the four colors, namely, yellow, cyan, magenta, and black, which are sequentially superposed on an intermediate transfer belt 10 to form a full color image.

The intermediate transfer belt 10, which is a moving member, is tautly stretched over and supported by a secondary transfer bias roller 21, primary transfer bias rollers 11 through 14, a sensor-facing roller 16, a secondary transfer opening facing roller 19, and a belt cleaning unit facing roller 20. The secondary transfer bias roller 21 also functions as a driving roller of the intermediate transfer belt 10 in the present embodiment. A not shown driving motor causes the secondary transfer bias roller 21 to drive the intermediate transfer belt 10 in the direction of the arrow shown in FIG. 1.

A reflection sensor 17 that reads toner patterns formed on the intermediate transfer belt 10 is disposed substantially facing the sensor-facing roller 16, which functions as a transfer member deformation preventing unit. For using the reflection sensor 17 to perform color shift correction control, a position shift correction pattern formed on each of the photosensitive drums 1 is transferred onto the intermediate transfer belt 10, so that the reflection sensor 17 can detect the pattern positions. The reflection sensor 17 calculates the magnitude of the shift based on the position data of each toner color and performs position shift correction control by correcting the write timing of the exposing unit 5. For using the reflection sensor 17 to perform image density adjustment control, an image density adjustment pattern formed on each of the photosensitive drums 1 is transferred onto the intermediate transfer belt 10, so that the reflection sensor 17 can detect a reflection density. The reflection sensor 17 performs image density adjustment control by adjusting the biases impressed on the charging unit or the developing unit based on the reflection density data for each toner color so that the intended reflection density is achieved.

The primary transfer bias rollers 11 through 14 are explained in detail in a later section. A blade 23 cleans the residual toner left on the intermediate transfer belt 10 after the transfer has taken place.

Each of the rollers tautly stretching and supporting the intermediate transfer belt 10 is supported on either side of the intermediate transfer belt 10 by a not shown side intermediate transfer belt unit side board. The intermediate transfer belt 10 is an endless resin film belt composed of polyvinylidene fluoride (PVDF), ethylene tetrafluorate copolymer (ETFE), polyimide (PI), polycarbonate (PC), etc. in which electric conductant material such as carbon black is dispersed. Alternatively, the intermediate transfer member having an elastic layer can be used.

Materials such as rubber, elastomer, resin etc., may be used for making the intermediate transfer member having an elastic layer. One or several of the following materials may be used as rubber and elastomer, namely, natural rubber, epichlorohydrin rubber, acrylic rubber, silicon rubber, fluorine-containing rubber, polysulphide rubber, polynorbornene rubber, isoprene rubber, styrene-butadiene rubber, butadiene rubber, butyle rubber, ethylene-propylene rubber, ethylene-propylene polymer, chloroprene rubber, chlorosulphonated polyethylene, chlorinated polyethylene, acrylonitrilebutadiene rubber, urethane rubber, syndiotactic 1,2-polybutadiene, hydrogenated nitrile rubber, and thermoplastic elastomer (for example, polystyrene series, polyolefin series, polychlorovinyl series, polyurethane series, polyamide series, polyester series, and fluorine-containing resin series).

One or several of the following resin types can be used, namely, styrene resin (simple polymer or copolymer containing styrene or a styrene derivative) phenol such as phenol resin, epoxy resin, polyester resin, polyester polyurethane resin, polyethylene, polypropylene, polybutadiene, polychlorovinylidene, ionomer resin, polyurethane resin, silicon resin, fluorine-containing resin, ketone resin, polystyrene, chloropolystyrene, poly-α-methylstyrene, styrene-butadiene copolymer, styrene-vinylchloride copolymer, styrene-vinyl acetate copolymer, styrene-maleic acid copolymer, styrene-acrylic ester copolymer (styrene-methyl acrylate copolymer, styrene-methyl methacrylate copolymer, styrene butyl acrylate copolymer, styrene-octyl acrylate copolymer, and styrene-vinyl acrylate copolymer), styrene-methacrylate ester copolymer (styrene-methyl methacrylate copolymer, styrene-ethyl methacrylate copolymer, and styrene-vinyl methacrylate copolymer), styrene-α-methyl chloroacrylate copolymer, and styrene acrylonitrile-acrylic ester copolymer, methyl methacrylate resin, butyl methacrylate resin, ethyl acrylate ersin, butyl acrylate resin, modified acrylic resin (such as silicon-modified acrylic resin, vinyl chloride resin-modified acrylic resin, and acrylic urethane resin), vinyl chloride resin, styrene-vinyl sulphate copolymer, vinyl chloride-vinyl sulphate copolymer, rhodine-modified vinyl sulphate copolymer, ethylene-ethyl acrylate copolymer, xylene resin, polyvinyl butyral resin, polyamide resin, and modified polyphenilene oxide resin, etc.

To adjust the resistance of he intermediate transfer member, various electric conductant agents may be added to the rubber, elastomer, and resin. One or several of the following conductant agents may be added, namely, carbon, metal power such as aluminium, nickel, etc., metallic oxide such as titanium oxide, methyl polymethacrylate containing quartenized ammonium salt, polyvinyl aniline, polyvinyl pyrrolee, polydiacetylene, polyethyleneimine, boron-containing high-polymer compound, and polypyrrol.

It is preferable to cover the elastic layer with a surface cover made of resin to protect it from staining (bleeding) from the photosensitive member and toner adhesion (filming), as well as with the objective of controlling toner charging, adjusting the surface resistance, and controlling the coefficient of friction, etc.

One or several of the following resin types may be used for forming the surface cover of the elastic layer, namely, fluorine-containing resin, urethane resin, polycarbonate resin, polyvinyl acetal resin, acrylic resin, silicon resin, polyester resin, amino resin, epoxy resin, polyamide resin, phenol resin, alkyd resin, melamine resin, ketone resin, ionomer resin, polybutadiene resin, chlorinated polyethylene, vinylidene chloride resin, acrylic urethane resin, acrylic silicon resin, ethylene vinyl sulphate resin, vinyl choloride vinyl sulphate resin, styrene acrylic resin, styrene butadiene resin, styrene maleic acid resin, ethylene acrylic resin, etc.

The intermediate transfer belt 10 is composed of a single layer of polyimide (PI) to which carbon black is added. The thickness of the intermediate transfer belt 10 is 100 micrometer (μm).

The resistance of the intermediate transfer belt 10 was measured by connecting a probe (having an inner electrode diameter of 50 millimeter (mm) and a ring electrode inner diameter of 60 mm, according to JIS-K6911 standards) to a digital ultra-high resistance/micro current meter (Product No. R8340, manufactured by Advantest), and a voltage of 100 V (surface resistivity 500 V) was impressed on both the surfaces of the intermediate transfer belt 10. The surface resistance during discharge was measured at 5 seconds and during charging was measured at 10 seconds. The temperature was kept constant at 22° C. and the relative humidity at 55% during the measurement of the surface resistance.

The volume resistivity of the intermediate transfer belt 10 is in the range of $10^7$ Ω-c to $10^{12}$ Ω-cm and the surface resistivity is in the range of $10^9$ Ω/□ to $10^{15}$ Ω/□. If the volume resistivity and the surface resistivity of the intermediate transfer belt 10 exceed the specified range, the bias required for transfer increases, increasing power consumption and hence the cost involved. Further, the charge potential of the surface of the intermediate belt 10 increases due to the discharge occurring in the transfer step and the transfer sheet separation step, necessitating provision of a discharge unit in the intermediate transfer belt 10 as self-discharge does not occur easily. On the other hand, if the volume resistivity and the surface resistivity of the intermediate transfer belt 10 fall below the specified range, the charge potential drops quickly, effecting self-discharge. However, toner scattering results due to the current flowing in the direction of the surface during transfer. Thus, the volume resistivity and the surface resistivity of the intermediate transfer belt 10 according to the present invention should be in the range specified earlier.

The secondary transfer bias roller 22 is composed of a core grid of SUS grade stainless steel, and the like, with an elastic cover composed of urethane, and the like, whose resistance is adjusted to $10^6$ Ω to $10^{10}$ Ω by a conductant material. If the resistance of the secondary transfer bias roller 22 exceeds the specified range, the current cannot flow easily, necessitating high voltage impression to accomplish transfer, thereby increasing the power consumption and the cost involved. Impression of high voltage causes discharge to occur at the air spaces before and after a transfer nip, resulting in white space on a colored background. This phenomenon is more prominent under low-temperature low-humidity conditions (for example 10° C. and a relative humidity of 15%). On the other hand, if the resistance of the secondary transfer bias roller 22 falls below the specified range, the transfer of the portion of the image made of a plurality of colors (for example, image with three superposed colors) as well as the portion of the image made of a single color cannot be simultaneously carried out. The relatively low voltage produces enough current for the transfer of a single-color image. However, for the transfer of a plural-color image, a higher potential is required. If a higher potential is impressed, the transfer current for the single-color image becomes far too much. Thus, transfer efficiency is compromised.

To measure the resistance of the secondary transfer bias roller 22, the secondary transfer bias roller 22 was set on a conductive metal plate. The core grid was weighted with 4.9 newtons (N) at each end (total of 9.8 N). The resistance was calculated from the current that flows when a voltage of 1000 V was impressed between the core grid and the metal plate.

The temperature was kept constant at 22° C. and the relative humidity at 55% during measurement of the resistance. Adjustments were made so that the resistance of the secondary transfer bias roller 22 according to the present embodiment measured by the method described above is 7.8 log ohms.

The primary transfer bias rollers 11 through 14 are structurally similar to the secondary transfer bias roller 22. This structure of the primary transfer bias roller 11 through 14, which presses against the photosensitive drum 1 with the intermediate transfer belt 10 sandwiched in between, ensures that the elastic layer primary transfer bias roller 11 through 14 forms a good primary transfer nip. The resistance range of the primary transfer bias roller 11 through 14 also must be in the similar range as that of the secondary transfer bias roller 22. Adjustments were made so that the resistance of the primary transfer bias roller 11 through 14 according to the present embodiment measured by the method described above is 7.0 log ohms.

Exactly when the edge of the toner image on the surface of the intermediate transfer belt 10 reaches a secondary transfer position, a transfer sheet 29 picked up by a pickup roller 28 and passed to a paper feeding roller 27 and a resist roller 26, is fed to the secondary transfer position. When a high-voltage power source 101 impresses a predetermined transfer bias (−2 kilovolts (KV) in the present embodiment), the toner image on the intermediate transfer belt 10 is transferred to the transfer sheet 29. The transfer sheet 29 separates from the intermediate transfer belt 10 due to the curvature of the secondary transfer opening facing roller 19 and a predetermined separation bias impressed by a separating unit 15. The toner image transferred on to the transfer sheet 29 is fixed by a fixing device 25. The transfer sheet 29 is then ejected.

The image forming apparatus according to the present invention has four image formation modes, namely, single-color mode, two-color mode, three-color mode, and full color mode, and allows selection of the desired mode by operating an actuator. The single-color mode produces an image of any of the colors yellow, magenta, cyan, and black. Likewise, the two-color mode and three-color mode produce an image of a combination of any two colors or three colors thereof, respectively. The full color mode produces a full color image in which all the four colors are superposed.

In the image forming apparatus according to the present embodiment, the process speed during fixing is adjustable according the type of the transfer sheet 29. Specifically, the process speed is made half-speed if a ream weight of the transfer sheet is 110 Kg or greater. That is, the transfer sheet takes twice as long as the normal time for traversing a fixing nip formed by a pair of fixing rollers, ensuring that the toner image fixed properly.

A ream is a bunch of thousand sheets, all of one specified dimension. Specifically, the weight of a thousand 4/6 sheets is called ream weight. The unit of ream weight is kilogram.

The secondary transfer step in which the toner image from the intermediate transfer belt 10 is transferred to the transfer sheet 29, also takes place at half-speed. Consequently, a "thick sheet mode" comes into force when bias is impressed upon the secondary transfer bias roller 22. In the image forming apparatus according to the present embodiment, the type of the transfer sheet can be specified by a not shown actuator. There are three options for transfer sheet, namely, "normal sheet mode" (normal process speed), "thick sheet mode" (half-speed), "transparency mode" (half speed).

Figure 2:
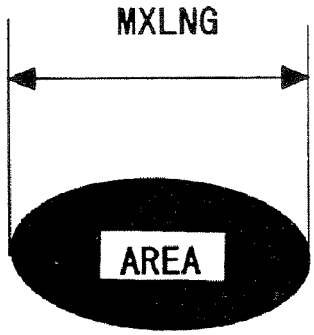
FIG. 2 is a schematic of a toner particle for explaining a shape factor SF-1.
Figure 3:
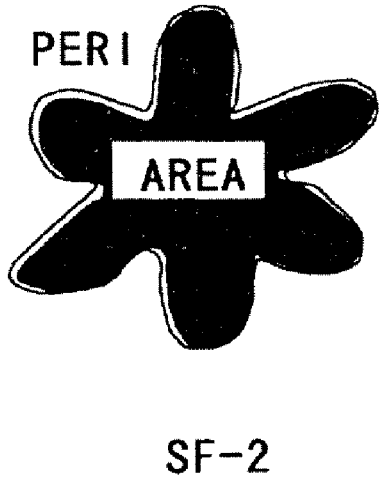
FIG. 3 is a schematic of a toner particle for explaining a shape factor SF-2.

Shape factors SF-1 and SF-2 of the toner used in the image forming apparatus according to the present embodiment should preferably be in the range of 100 to 180. FIG. 2 and FIG. 3 are schematics of the shape of a toner particle for explaining shape factors SF-1 and SF-2. The shape factor SF-1 indicates a roundness ratio of the toner shape and is determined by Equation 1 given below. The shape factor SF-1 is obtained by dividing by a drawing area AREA a maximum length MXLNG of the shape obtained by projecting the toner on a two-dimensional plane, and multiplying the quotient by 100π/4.

$$SF\text{-}1=\{(MXLNG)^2/\mathrm{AREA}\}\times(100\pi/4) \quad (1)$$

The toner is perfectly spherical when the value of shape factor SF-1 is 100. As the value gets further from 100, the shape of the toner becomes more indeterminate.

The shape factor SF-2 represents an unevenness ratio of the toner shape and is determined by Equation 2 given below. The shape factor SF-2 is obtained by dividing by a drawing area AREA a perimeter PERI of the shape obtained by projecting the toner on a two-dimensional plane, and multiplying the quotient by 100π/4.

$$SF\text{-}2=\{(\mathrm{PERI})^2/\mathrm{AREA}\}\times(100\pi/4) \quad (2)$$

The toner surface is devoid of unevenness when the value of shape factor SF-2 is 100. As the value gets further from 100, the unevenness becomes more prominent.

The shape factor was calculated by taking a picture of the toner using a scanning electron microscope (S-800, manufactured by Hitachi), and feeding the picture of the toner into an image analyzer (LUSEX3, manufactured by Nireco).

As the shape of the toner tends towards spherical, the contact surface between two toner particles or between the toner particle and the photosensitive member would tend to be less, weakening the cohesiveness between the toner particles and increasing the mobility of the toner particles. Also, the adhesiveness between the toner particle and the photosensitive member will weaken, increasing the transfer rate. It is preferable that both SF-1 and SF-2 remain under 180, as exceeding 180 would decrease the transfer rate.

Exemplary embodiments according to the present invention are described in greater detail next. The characteristic feature of a first embodiment according to the present invention is described next.

As shown in FIG. 1, the reflection sensor 17 is set in close proximity to the secondary transfer bias roller 21. The purpose behind the setting of the reflection sensor 17 is to read the color shift correction pattern or the density correction control pattern in the shortest possible time after the primary transfer so that the control can be administered in the shortest possible time.

To accomplish the reading the color shift correction pattern and the density correction control pattern in even shorter time, the reflection sensor 17 would need to be placed facing the secondary transfer bias roller 21. However, at this position, the reflection sensor 17 also ends up being in close proximity to the transfer sheet 29, increasing the proneness to toner dispersion and image smudging. The effect is particularly conspicuous after the rear edge of the transfer sheet 29 gets past the secondary transfer unit. Therefore, this position is not a preferred one.

Another position for the reflection sensor 17 for accomplishing the tasks mentioned above in the shortest possible time is near the secondary transfer opening facing roller 19. However, setting the reflection sensor 17 close to the secondary transfer opening facing roller 19 causes the sensor reader to face up, making the sensor reader prone to staining by the toner, leading to faulty reading or, inability to read, depending on the case.

If no sensor-facing roller 16 is provided, it will cause the distance between the reflection sensor 17 and the intermediate transfer belt 10 to vary due to the shaking motion of the intermediate transfer belt 10 when rotating, resulting in decreased reading precision. Therefore, provision of the sensor-facing roller 16 is essential.

In the present embodiment, the secondary transfer bias roller 21 and the sensor-facing roller 16 are set close to each other. The outer surface of the sensor-facing roller 16 is composed of an insulation material.

Figure 4:
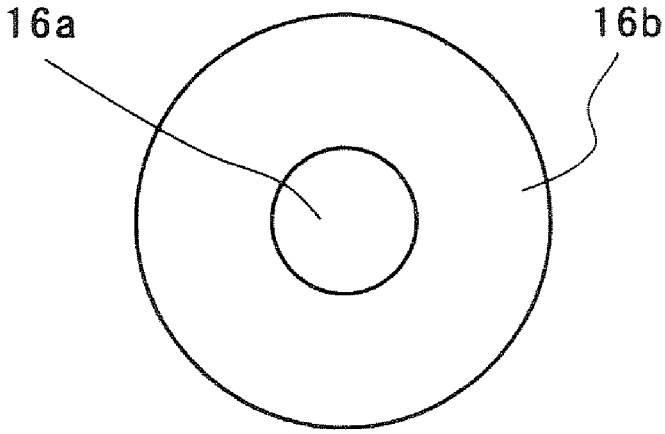
FIG. 4 is a cross-section of a core of a sensor-facing roller according to a first embodiment of the present invention.

FIG. 4 is a cross-section of a core of the sensor-facing roller according to the first embodiment. Specifically, the sensor-facing roller 16 includes a metal core 16*a* and a resin member 16*b* around the metal core 16*a*. The resin used is polyacetal (POM). The thickness of the resin is 5 mm.

The present embodiment enables color shift correction control and image density adjustment control to be carried out in a very short time and with high precision. Furthermore, the present embodiment enables prevention of discharge due to leakage of voltage between the secondary transfer bias roller 21 and the sensor-facing roller 16, thus preventing noise and void due to weakening of the electric field caused by discharging.

Figure 5:
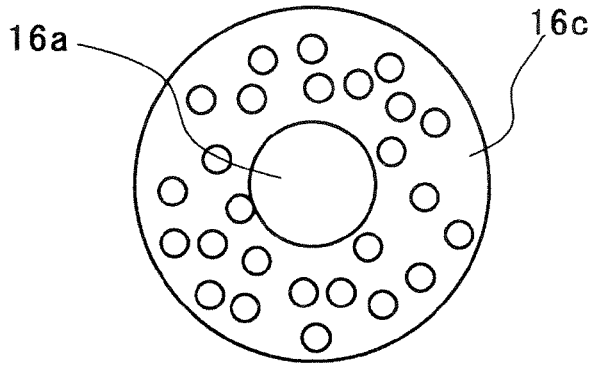
FIG. 5 is a cross-section of a core of a sensor-facing roller according to a second embodiment of the present invention.
Figure 6:
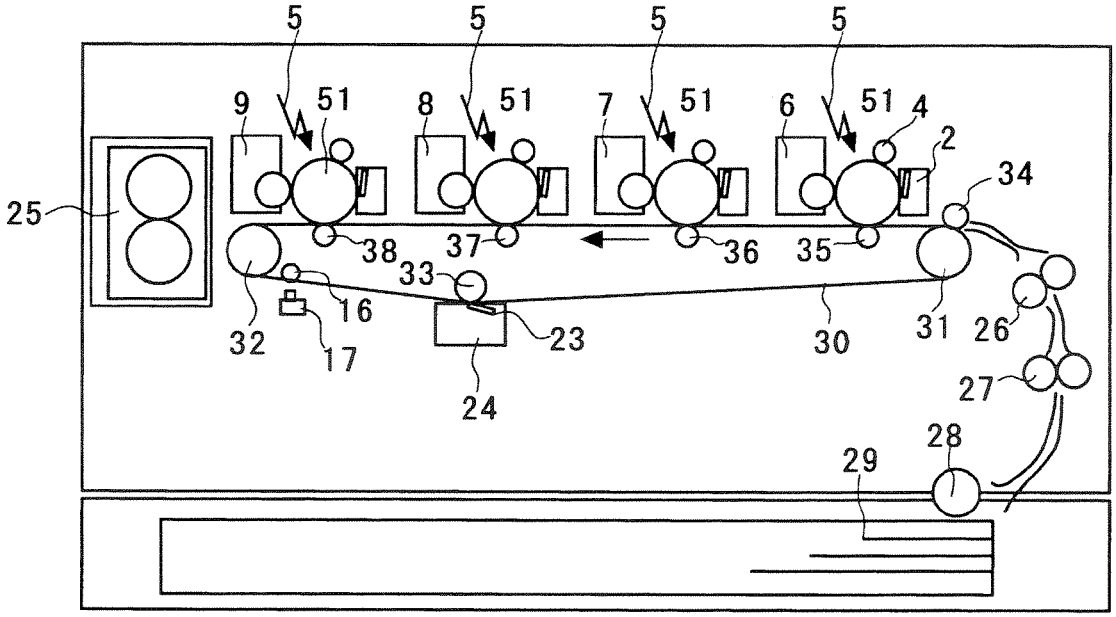
FIG. 6 is a schematic of an image forming apparatus according to the second embodiment.

FIG. 5 is a cross-section of a core of the sensor-facing roller according to a second embodiment of the present invention. FIG. 6 is a schematic of an image forming apparatus according to the second embodiment. Unlike the first embodiment, in the second embodiment, instead of the intermediate transfer member, a transfer sheet carrying belt 30 is stretched and supported. The step of toner image formation on the photosensitive drum 1 in the present embodiment is identical to that of the first embodiment and is therefore not described again. The same materials that are mentioned for the intermediate transfer belt 10 according to the first embodiment can be used for the transfer sheet carrying belt 30 as well. However, the transfer sheet carrying belt 30 according to the present embodiment is a single layer belt composed of PVDF. The volume resistivity of the transfer sheet carrying belt 30 is $10^{10}$ Ω-cm and the surface resistivity is $10^{11}$ Ω/□.

The transfer sheet carrying belt 30 is tautly stretched over and supported by a transfer sheet adhesion inducer facing roller 31, a transfer sheet separation bias roller 32, and a cleaning unit facing roller 33. A transfer sheet adhesion inducing roller 34 is set pressed against the transfer sheet adhesion inducer facing roller 31 with the transfer sheet carrying belt 30 sandwiched in between. The cleaning unit facing roller 33 also functions as the driving roller that rotates the transfer sheet carrying belt 30 by driving it. To cause the transfer sheet 29 to electrostatically adhere to the transfer sheet carrying belt 30, a voltage of 500 V is impressed on the transfer sheet adhesion inducing roller 34. The transfer sheet 29 is borne by the pickup roller 28, the paper feeding roller 27, and the resist roller 26 at a specified time and conveyed to the transfer sheet carrying belt 30, to which the transfer sheet 29 adheres. The transfer sheet 29 is carried to the point of contact to each of the photosensitive members, and transfer rollers 35 through 38 set on the backside of the transfer sheet carrying belt 30 cause the toner images to be sequentially transferred to the transfer sheet 29. A constant current of 15 microamperes (μA) from a not shown high-voltage power source controls the transfer rollers 35 through 38. When the toner images of all colors are transferred to the transfer sheet 29, the transfer sheet 29 is carried up to the transfer sheet separation bias roller 32, which impresses a separation bias. The transfer sheet 29 separates from the transfer sheet carrying belt 30 due to the separation bias and the curvature of the transfer sheet separation bias roller 32. The transfer sheet 29 is then carried to the fixing device 25, which fixes the toner images by application of heat and pressure. In the present embodiment, a voltage of +2500 V is impressed on the transfer sheet separation bias roller 32 for the transfer sheet 29 to separate from the transfer sheet carrying belt 30.

As shown in FIG. 6, the sensor-facing roller 16 is provided in the present embodiment as well. If no sensor-facing roller 16 is provided, it will cause the distance between the reflection sensor 17 and the transfer sheet carrying belt 30 to vary due to the shaking motion of the transfer sheet carrying belt 30 when rotating, resulting in decreased reading precision. Therefore, provision of the sensor-facing roller 16 is essential.

In the present embodiment also, the secondary transfer bias roller 21 and the sensor-facing roller 16 are set close to each other, and the outer surface of the sensor-facing roller 16 is composed of an insulation material. Specifically, as shown in FIG. 5, the metal core 16*a* of the sensor-facing roller 16 is covered all around by an insulation foam member 16*c*. The insulation foam member 16*c* is foamed polyurethane having a volume resistivity of over $10^{12}$ ohms and a thickness of 6 mm.

The present embodiment enables color shift correction control and image density adjustment control to be carried out in a very short time. Furthermore, the present embodiment enables prevention of discharge due to leakage of voltage between the transfer sheet separation bias roller 32 and the sensor-facing roller 16, thus preventing noise and transfer sheet separation failure caused by discharging.

The sensor-facing roller can be an integrated unit composed of resin or ceramic instead of having a core and a covering layer structure described in the first embodiment and the second embodiment. As a covering material any insulation material may be used in place of POM and foamed polyurethane used in the first embodiment and the second embodiment. The intermediate transfer belt described in the first embodiment is a single layer belt. However, by using an intermediate transfer belt having a plurality of layers, the surface resistivity and the volume resistivity can be independently adjusted, thus optimizing transferability. The surface layer can be made more conducive to separation by using a covering layer having an excellent separating ability, making it ideal for toner removal.

According to the present invention, a highly efficient and a superior quality color image forming apparatus can be realized that can carry out color shift correction control and image density adjustment control.

Although the invention has been described with respect to a specific embodiment for a complete and clear disclosure, the appended claims are not to be thus limited but are to be construed as embodying all modifications and alternative constructions that may occur to one skilled in the art that fairly fall within the basic teaching herein set forth.

What is claimed is:

1. An image forming apparatus, comprising:

an image carrier;

a latent image forming unit configured to form a latent image on the image carrier;

a developing unit configured to form a plurality of toner images of the latent image, the toner images formed in different colors;

a moving member configured to move in contact with the latent image forming unit at a transfer position;

a control pattern forming unit configured to form a control pattern on the moving member, the control pattern including an image density control pattern;

a control pattern detecting unit configured to detect the control pattern;

a deformation preventing unit arranged on a rear side of the moving member at a position facing the control pattern detecting unit; and a plurality of tension applying members configured to apply tension to the moving member from inside a structure of the moving member to tautly support the moving member, wherein the deformation preventing unit and one of the tension applying members being a primary transfer bias impressing unit included in a bias impressing unit that impresses a bias are arranged in close proximity to each other, and a surface of the deformation preventing unit is formed with an insulating material.

2. The image forming apparatus according to claim 1, wherein the control pattern includes a position detection pattern.

3. The image forming apparatus according to claim 1, wherein the image carrier and the developing unit are provided in plurality and arranged in parallel.

4. The image forming apparatus according to claim 1, wherein the moving member includes a sheet carrying unit configured carry a transfer sheet while making the transfer sheet adhered thereto.

5. The image forming apparatus according to claim 1, wherein the moving member includes an intermediate transfer belt, and the image forming apparatus further comprises:

a primary transfer unit configured to sequentially transfer color toner images formed on the image carrier onto the intermediate transfer belt;

a secondary transfer unit arranged in contact with a transfer sheet and configured to transfer the color toner images on the intermediate transfer belt onto the transfer sheet.

6. The image forming apparatus according to claim 1, wherein the bias impressing unit includes a secondary transfer bias impressing unit.

7. The image forming apparatus according to claim 1, wherein the bias impressing unit is configured to function as a driving unit that drives the moving member to rotate.

8. The image forming apparatus according to claim 1, wherein the deformation preventing unit includes a rotatable roller.

9. The image forming apparatus according to claim 1, wherein the moving member includes an endless single layer belt.

10. The image forming apparatus according to claim 1, wherein the moving member includes an endless multi-layer belt.

11. The image forming apparatus according to claim 1, wherein a toner to form the toner image includes a polymer toner manufactured by a polymerization method.

12. The image forming apparatus according to claim 11, wherein a first shape factor SF-1 of the toner is in a range of 100 to 180 and a second shape factor SF-2 of the toner is in a range of 100 to 180.

* * * * *